United States Patent [19]

Kamohara

[11] Patent Number: 4,870,321

[45] Date of Patent: Sep. 26, 1989

[54] COLOR CATHODE RAY TUBE

[75] Inventor: Eiji Kamohara, Fukaya, Japan

[73] Assignee: Kabushiki Kaisha Toshiba, Kawasaki, Japan

[21] Appl. No.: 240,451

[22] Filed: Sep. 2, 1988

Related U.S. Application Data

[63] Continuation of Ser. No. 26,464, Mar. 16, 1987, abandoned.

[30] Foreign Application Priority Data

Mar. 19, 1986 [JP] Japan ..... 61-59321

[51] Int. Cl.[4] ..... H01J 29/51

[52] U.S. Cl. ..... 313/414; 313/428

[58] Field of Search ..... 313/412, 413, 414, 428, 313/447

[56] References Cited

U.S. PATENT DOCUMENTS

| | | | |
|---|---|---|---|
| 3,448,316 | 6/1969 | Yoshida et al. . | |
| 4,086,513 | 4/1978 | Evans | 313/414 |
| 4,350,923 | 9/1982 | Hughes | 313/414 |
| 4,528,476 | 7/1985 | Alig . | |

FOREIGN PATENT DOCUMENTS

| | | |
|---|---|---|
| 49-5591 | 2/1974 | Japan . |
| 5174801 | 1/1978 | Japan . |

OTHER PUBLICATIONS

Electronic Design, vol. 31, No. 7, 31st Mar. 1983, pp. 38–39, Waseca, Minn., Denville, N.J., U.S.; V. Biancomano: "Color Tube Retains Focusing Accuracy Despite Small Yoke".

*Primary Examiner*—Donald J. Yusko
*Assistant Examiner*—Sandra L. O'Shea
*Attorney, Agent, or Firm*—Cushman, Darby & Cushman

[57] ABSTRACT

In an electron gun assembly for a cathode ray tube, the center and side electron beams emitted from cathodes are incident on a main electric lens. The center and side electron beams are focused, respectively. The side beams are over-converged and directed to an over-converged point by the main electric lens. The side beams emerged from the main electric lens are deflected and corrected by a divergent lens so that the center and side beams are converged on a proper converged point between the screen and the over-converged point.

5 Claims, 7 Drawing Sheets

COLOR CATHODE RAY TUBE

This is a continuation of application Ser. No. 07/26,464, filed Mar. 16, 1987, which was abandoned upon the filing hereof.

BACKGROUND OF THE INVENTION

This invention relates to a color cathode ray tube and, in particular, to a main lens unit for electron guns which focuses and converges a plurality of electron beams.

In a color cathode ray tube, electron beams emitted from an electron gun assembly are focused and converged at a target where electron beam spots are formed. As one important factor for determining the performance of the color cathode ray tube, use is made, of, for example, the beam spot size on the target in which case the smaller the beam spot size the better. The beam spot size is determined by the performance of the electron gun assembly.

In general, the electron gun assembly comprises an electron beam generating section for effecting the generation and control of electron beams and a main lens unit for accelerating and focusing the electron beams. One effective method for improving the performance of the electron guns is to improve the performance of the main lens unit.

The main lens unit is mostly formed of electrostatic lenses and a plurality of electrodes having an opening are located on the same axis so as to apply a predetermined potential.

The electrostatic lenses are classified into various types by the differences in their electrode configuration. Basically, the lens performance can be improved by either increasing the diameter of the electrode opening to provide a larger-aperture lens or by making the electrode-to-electrode distance longer to provide a lens of a longer focal point.

However, since electron guns are inserted into a narrower glass cylinder section called the neck section of the color cathode ray tube, the electrode opening, i.e., the lens aperture, is physically restricted and, moreover, the electrode-to-electrode distance is restricted in order that a converging electric field created between the electrodes may not be influenced by the other undesired electric fields within the neck section.

In particular, with the three electron guns arranged in a delta array or in an in-line array as in the color cathode ray tube, the corresponding three electron beams are readily converged at one point in the neighborhood of a whole screen surface as the beam-to-beam distance becomes smaller and smaller. Furthermore, the deflection power may also advantageously be decreased. Thus the design tendency is toward decreasing the distance between the electrodes and toward decreasing the electrode opening.

Japanese Patent Publication (KOKOKU) No. 49-5591, corresponding U.S. Pat. No. 3,448,316 and U.S. Pat. No. 4,528,476 disclose a lens unit in which, in order to improve the lens performance, three electron lenses in a common plane are replaced by a single electron lens corresponding to a completely superimposed lens array so that three electronic beams pass through the center portion of that large-aperture electron lens in an intersecting fashion. FIG. 1 shows a view corresponding to an optically equivalent array of the electron guns as disclosed in Japanese Patent Publication (KOKOKU) No. 49-5591 (U.S. Pat. No. 3,448,316).

The electron beams 3A, 3B, and 3C emitted from cathode units 9A, 9B and 9C are previously focused by prefocusing lenses 20A, 20B and 20C and directed toward the center of larger-aperture electron lens 51. The electron beams 3A and 3C emerging from larger-aperture electron lens 51 are strongly deflected by deflecting means 51A and 51C at a deflection angle $+\phi°$ and converged at screen 30.

In this type of the tube, the center electron beam encounters no aberration while, side electron beams 3A and 3C experience a greater deflection error or coma so that the three electron beams 3A, 3B and 3C are formed, as spots of different sizes, on screen 30. In order to alleviate the beam deformation, control is required to somewhat weaken the deflection performance of larger-aperture electron lens 51 in which case it is not possible for larger-aperture lens 51 to exhibit its own inherent performance.

FIG. 2 shows an optically equivalent array of electron guns as disclosed in U.S. Pat. No. 4,528,476. As evident from FIG. 2, electron beams 3A, 3B and 3C emitted from cathode units 9A, 9B and 9C are preliminarily focused by prefocus lenses 20A, 20B and 20C and directed to the center of one larger-aperture electron lens 51 after one of the beams has been deflected by deflection lens 53A and another has been deflected by deflection lens 53C.

The electron beams 3A and 3C emerging from large-aperture electron lens 51 are strongly deflected, by larger-aperture lens, at a greater deflection angle and converged at screen 30. Even in this electron gun assembly, electron beams 3A and 3C encounter a greater deflection error or coma, so that three electron beams 3A, 3B and 3C emerge as beam spots of different sizes on screen 30.

As set out above, in U.S. Pat. No. 4,528,476, and Japanese Patent Publication No. 49-5591 (U.S. Pat. No. 3,448,316), larger-aperture converging lens 51 cannot fully exhibit its own inherent performance.

In order to prevent such a strong deflection, it may be considered that electron beams are incident in a parallel mode onto a larger-aperture converging lens such that the center electron beam passes through the lens with both the side electron beams passing through the marginal portions of the lens. Even in the electron gun assembly of this type, however, both the side beams are over-converged so that the three electron beams are separated too away from one another on the screen.

Thus, as has been indicated, the problems arise from the conventional structure where the three electron beams pass through the common larger-aperture lens and hence difficultly is encountered in putting it into actual use.

SUMMARY OF THE INVENTION

It is accordingly the object of this invention to provide a color cathode ray tube equipped with an electron gun assembly which converges and focuses a plurality of electron beams, in which the lens performance of the main lens unit of the electron gun assembly is improved, which attains an excellent image quality.

An electron gun assembly for a cathode ray tube is provided which comprises:

a beam generating means for generating first, second and third electron beams;

a main electric lens unit for focusing the first, second and third electron beams onto a screen, respectively, and for over-converging the second and third electron beams and directing the second and third electron beams to an over-converged point between the main electric lens unit and the screen; and means for correcting the over-focused second and third electron beams to converge the second and third electron beams at a proper converging point between the over-converged point and the main electric lens unit, in which the first, second and third electron beams are crossed at the proper converging point only.

DETAILED DESCRIPTION OF THE PREFERRED EMBODIMENTS

Figure 1:
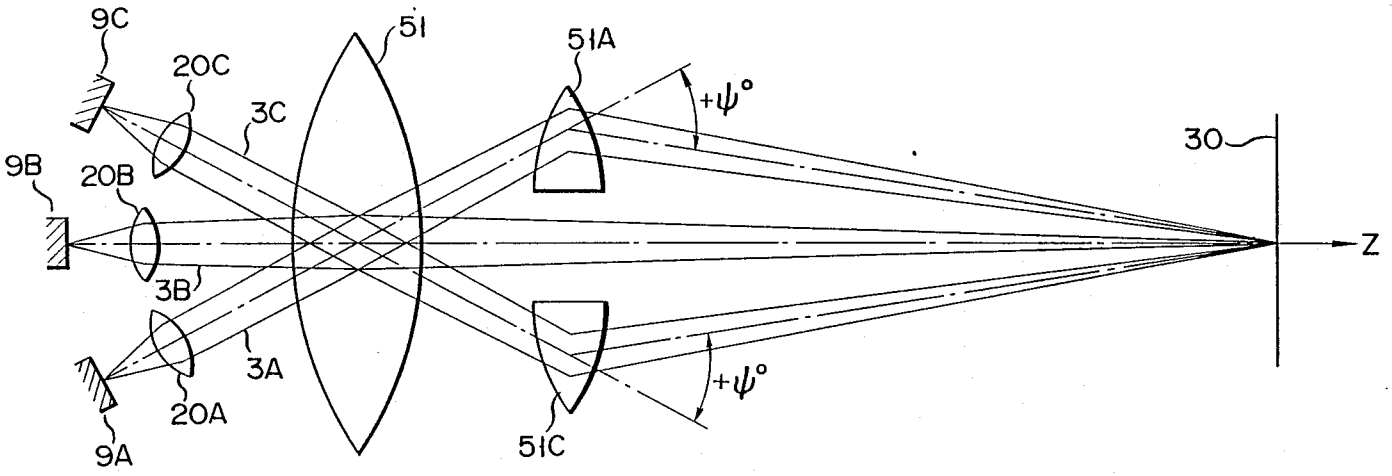
FIG. 1 (PRIOR ART)
FIGS. 1 and 2 are diagrammatic views showing an electron lens system of a conventional electron gun assembly.
Figure 2:
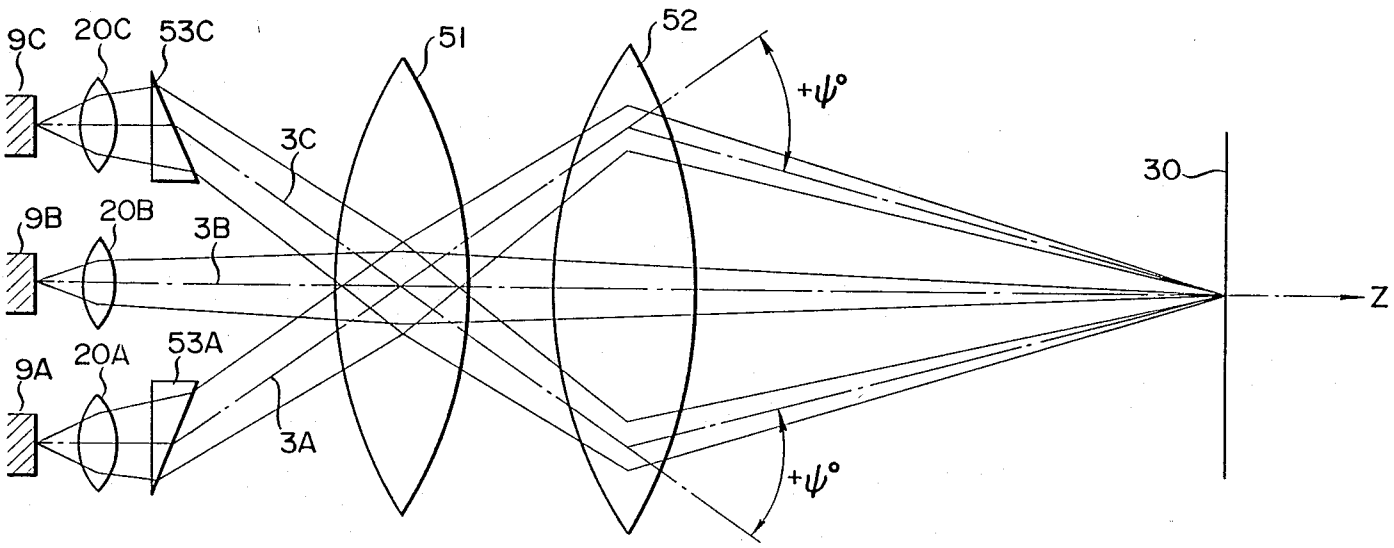
FIG. 2 (PRIOR ART)
Figure 3:
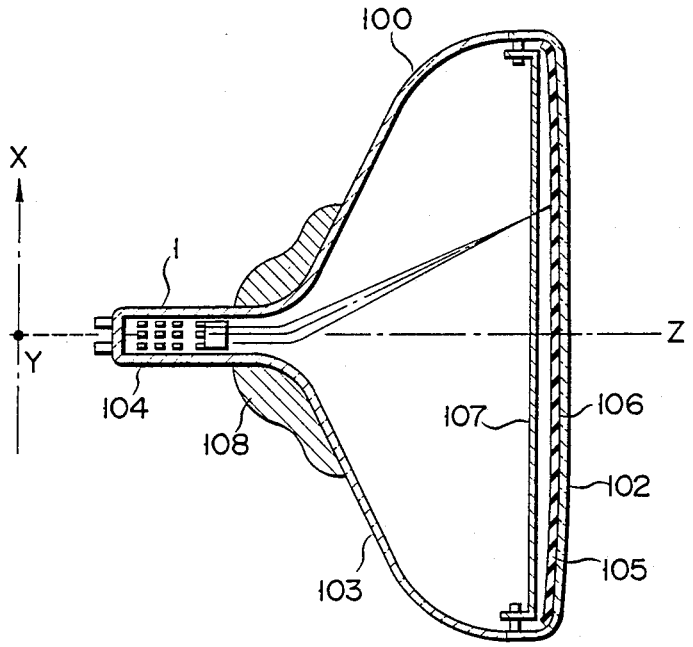
FIG. 3 is a diagrammatic view, in section, showing a cathode ray tube structure.

FIG. 3 is diagrammatic view showing an ordinary cathode ray tube. Envelope 100 of the cathode ray tube is connected to neck section 104 through funnel section 103 and to panel 102. Phosphor layer 105, comprised of R, G and B phosphor stripes, is formed on screen 106 of panel 102 in which case the phosphor strips extend in the Y-axis direction in FIG. 3. Shadow mask 107 is fixed to panel 102 and faces screen 106. Electron gun assembly 1 is contained in neck section 104, with three electron guns arranged in an in-line array in the X-Z plane and spaced a predetermined distance away from each other. Deflection yoke 108 is located around a junction area between funnel section 103 and neck section 104.

Figure 4:
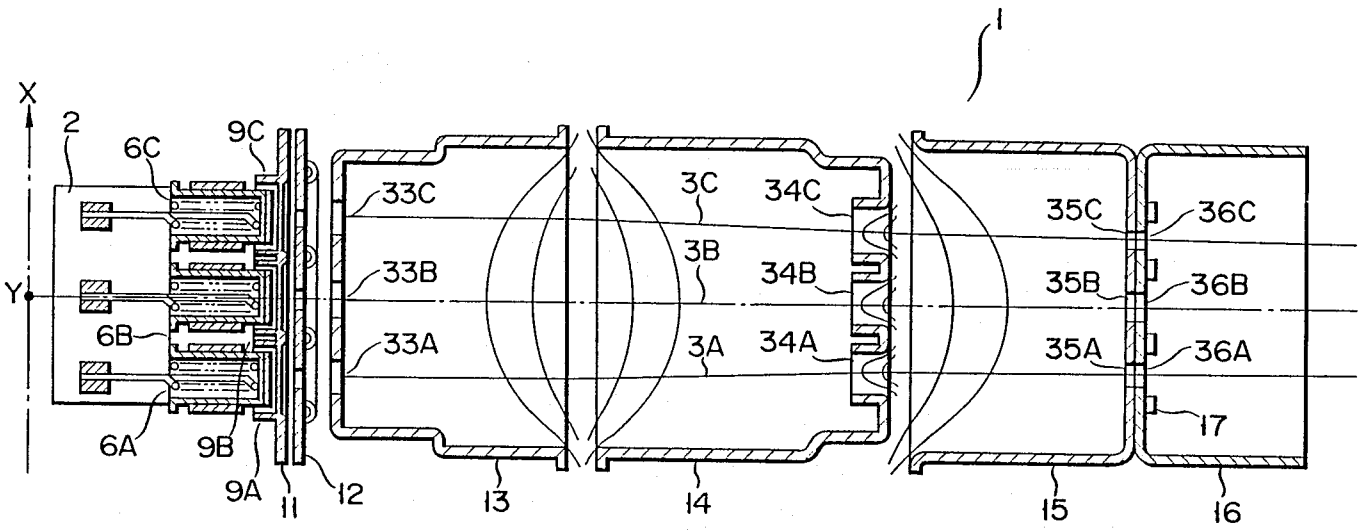
FIG. 4 is a cross-sectional view diagrammatically showing an electron gun assembly according to one embodiment of this invention.

Electron gun assembly 1 includes, as shown in FIG. 4, cathode units 9A, 9B and 9C, third to fifth grids 13 to 15 of a unitized structure opposite to cathode units 9A, 9B and 9C and convergence electrode 16. Cathode units 9A, 9B and 9C are provided with heaters 6A, 6B and 6C therein, respectively, which generate three electron beams to be landed on red, blue and green phosphor stripes on screen 106. Third to fifth grids 13 to 15 and convergence electrode 16 have holes, through which electron beams emitted from cathode units 9A, 9B and 9C pass, with the grid located opposite to cathode units 9A, 9B and 9C. Grids 13 to 15 and electrode 16 are supported by insulating support plate 2.

First and second grids 11 and 12 are located in close proximity, and are formed of plate-like electrodes. Third grid 13 is formed of a cup-like electrode with its base situated on the side of second grid 12, and has, at the bottom, beam passage holes 33A, 33B and 33C corresponding to the beam passage holes of the second grid. Fourth grid 14 is formed of a cup-like electrode with its bottom situated on the side of fifth grid 15, and has beam passage holes 34A, 34B and 34C at the bottom. Fifth grid 15 is formed of a cup-like electrode with its base situated on the side of convergence electrode 16, and has beam passage holes 35A, 35B and 35C at the bottom. Convergence electrode 16 is formed of a cup-like electrode with its bottom situated on the side of fifth grid 15, and has beam passage holes 36A, 36B and 36C at the bottom. Magnetic field correcting elements 17 are arranged in the neighborhood of the bottom of convergence electrode 16 to allow three electron beams to be exactly converged onto the screen (not shown). A bulb spacer (not shown) is attached to convergence electrode 16 to allow a high voltage of about 25 to 30 KV to be applied to an anode terminal.

A cutoff voltage of about 150 V and modulation signal are applied to, for example, cathode units 9A, 9B and 9C, and first grid 11 is maintained at a ground potential level. About 300 to 700 V, about 4 to 6 KV, about 15 to 20 KV and about 25 to 30 KV are applied to the second, third, fourth and fifth grids, respectively.

Figure 5:
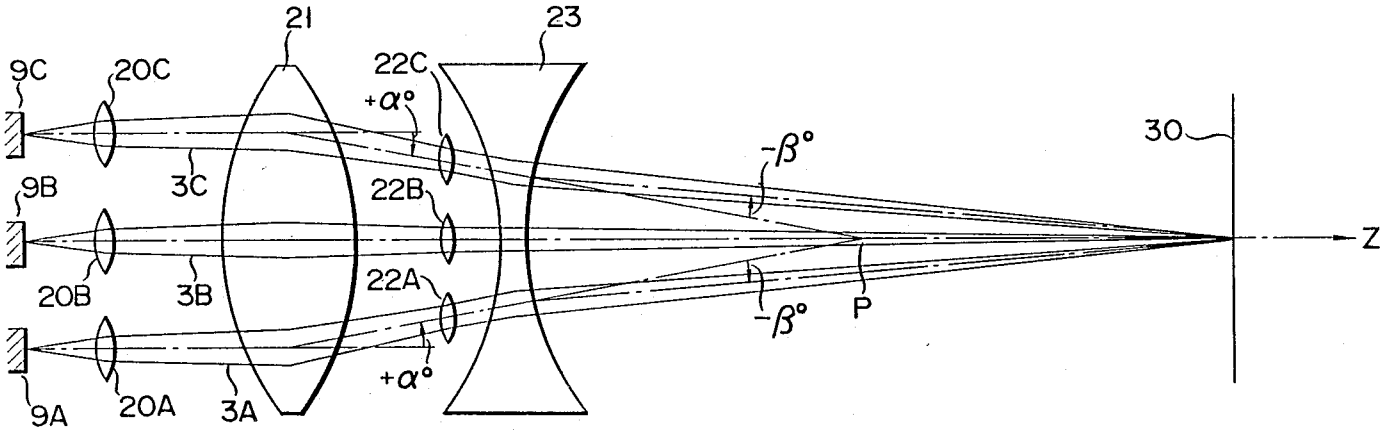
FIG. 5 is a diagrammatic view showing an electric lens system of the electron gun assembly of FIG. 4.

The equipotential curve of the main lens unit is as shown in FIG. 4. One larger-aperture concave or converging lens 21 is formed, as an electron lens, between third and fourth grids 13 and 14, as shown in FIG. 5. Concave or converging lenses 22A, 22B and 22C and larger-aperture convex or diverging lens 23 are formed, as electron lenses, between fourth and fifth grids 14 and 15. In general, a weaker diverging electron lens is formed behind concave electron lens 21 of a larger aperture and, here, it is included in concave electron lens 21.

Electron beams 3A, 3B and 3C emitted from cathode electrodes 9A, 9B and 9C are controlled by first and second grids 11 and 12, then preliminary focused by prefocus lenses **20*a*, 20*b* and 20*c* formed between second and third grids 12 and 13, and subjected to a primary focus by electron lens 21 formed between third and fourth grids 13 and 14**.

At this time, electron beams 3A and 3C, on both sides of center beam 3B, are somewhat more strongly converged than center beam 3B and deflected through an angle of $+\alpha°$ toward the center beam 3B, whereby the three electron beams are directed to an over-converged point.

However, the electron beams 3A to 3C are subjected to a preliminary focus by concave electron lenses 22A, 22B and 22C formed between fourth and fifth grids 14 and 15, and focused electron beams 3A and 3C are slightly diverged by convex electron lens 23 of a larger aperture as to have a focused power weaker than that of center electron beam 3B. Electron beams 3A and 3C are also deflected by convex electron lens 23, at an angle of $-\beta°$, in a direction away from center electron beam 3B. Here, the center electron beam passes through the electric optical axis and is not substantially diverged by convex lens 23 of a larger aperture. For this reason, three electron beams 3A, 3B and 3C are exactly converged at one convergent point in the neighborhood of screen 30, for example, in an aperture of the shadow mask and are properly focused on screen 30. The positive aberration of electron beams 3A and 3C emerging from converging electron lens 21 is offset by the negative aberration produced in the divergent electron lens of a larger aperture. As a result, the three beam spots of the same size and the same shape are formed on screen 30, thus eliminating a risk of forming a deformed side electron beams.

Thus the larger-aperture electron lens which is formed between third and fourth grids 13 and 14 can adequately exhibit its own inherent performance.

Although, in the aforementioned embodiment, the beam passage holes of the respective grids are circular in configuration, this invention is not restricted thereto. Where, for example, a beam spot on the center of the screen is made vertically elliptic in pattern so as to decrease a halo at the marginal edge portion of the screen of a larger-angle deflection tube, it is only necessary to form the electron passage hole as an elliptic hole. It is also possible to vary the cuplike electrode, while an installation location is secured for the insulating support.

Although, in the aforementioned embodiment, the three electron beams 3A to 3C have been explained as being incident in parallel onto the larger-aperture lens formed between third and fourth grids 13 and 14, this invention is not restricted thereto. In order to prevent the focused three beam spots from being varied even if a potential (a focusing potential) on third grid 13 varies, Japanese Patent Publication (KOKOKU) No. 60-51232 discloses an electron lens system in which the electron beams on both sides of a center electron beam are preliminarily deflected toward the center beam by a nonsymmetric lens formed between second and third grids 12 and 13 so that the focusing variation is offset even if a potential on third grid 13 varies. As evident from the above, this invention may be applied to this electron lens system.

Although, in the aforementioned embodiment, the diverging electron lens of a larger aperture is formed between fourth and fifth grids 14 and 15, either the arrangement on the fourth and fifth grids 14 and 15 may be modified, or a simpler correction plate may be provided, in order to minutely control the variance or the beam deformation.

Figure 6:
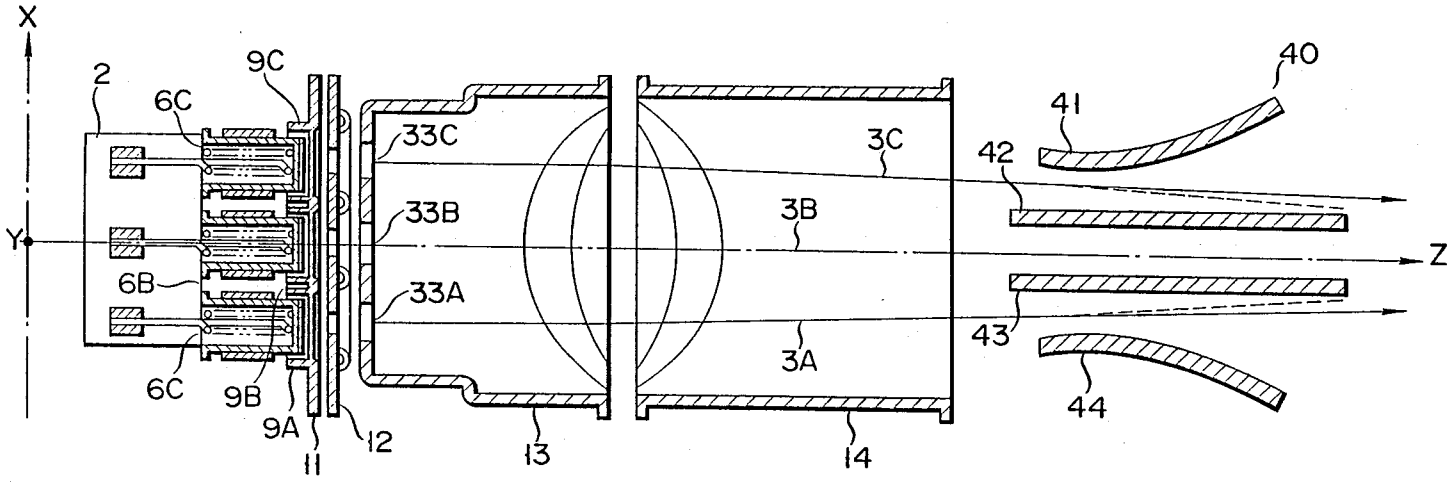
FIG. 6 is a cross-sectional view diagrammatically showing an electron gun assembly according to another embodiment of this invention.
Figure 7:
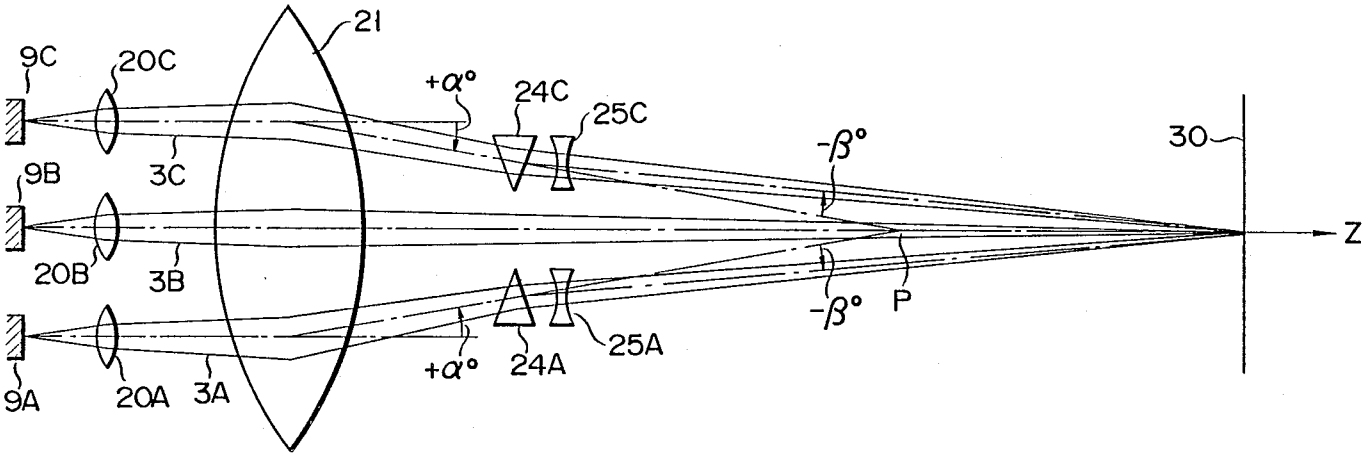
FIG. 7 is a diagrammatic view showing the electric lens system of the electric gun assembly of FIG. 6.

Another embodiment of this invention will now be explained below with respect to FIGS. 6 and 7. In this embodiment, similar reference numerals are employed to designate parts or elements corresponding to those shown in the preceding embodiment. Further explanation is, therefore, omitted.

In this embodiment, fourth grid 14 is formed of a single cylindrical electrode and electrostatic deflection plate unit 40 is provided on that side of deflection plate unit 40 where screen 105 is provided. The electrostatic deflection plate unit is comprised of four plate-like electrodes 41, 42, 43 and 44 in a substantially parallel array. Two inner plate-like electrodes 42 and 43 are arranged parallel to each other. Two plate-like electrodes 41 and 44 located one on each side of the parallel array of plate-like electrodes 42 and 43 are outwardly curved away from the parallel array of plate-like electrodes 42 and 43. In this case, a potential, which is slightly higher than that applied to plate-like electrodes 42 and 43, is applied to plate-like electrodes 41 and 44 so that electron beams 3A and 3C may be deflected away from center electron beam 3B. At this time, a diverging lens is formed relative to the electron beams at both sides of the center beam, since plate-like electrodes 41 and 44 are curved outwardly away from the inner array of plate-like electrodes 42 and 43.

For example, a voltage of about 5 to 10 kV is applied to third grid 13, about 25 to 30 kV is applied to plate-like electrodes 42 and 43, and a voltage higher by a few hundred to 1 kV than that applied to plate-like electrodes 42 and 43 is applied across plate-like electrodes 41 and 44. In this case, an electric lens system is provided as indicated by an equivalent optical model in FIG. 7.

Three electron beams 3A, 3B and 3C, which are emitted from cathode units 9A, 9B and 9C, pass through prefocus lenses 20A, 20B and 20C. They are focused by concave electron lens 21 of a larger aperture arranged between third and fourth grids 13 and 14 and side electron beams 3A and 3C somewhat strongly converged after being deflected by concave electron lens 21 at a delfection angle of $+\alpha°$ toward the center electron beam 3B. As it is, the three electron beams are directed to a over converged point P as indicated by a dot-dash line. According to this embodiment, electron beams 3A and 3C are correctively deflected, through a deflection angle of $-\beta°$, away from center beam 3B under the action of electrical prisms 24 formed by electrostatic deflection plate 40. Hence, the three electron beams are converged on one convergent spot in the neighborhood of screen 30. Electron beams 3A and 3C are overfocused by larger-aperture electron lens 21 upon comparison with center electron beam 3B. Nevertheless, these electron beams are corrected by diverging lenses 25A and 25C formed at the location of electrostatic deflection plate 40 so that electron beams 3A and 3C, together with center electron beam 3B, are properly focused on screen 30 on which the beam spots of same size and same shape is formed.

In Japanese Patent Publication (KOKOKU) No. 49-5591 and U.S. Pat. No. 4,528,476, electron beams 3A and 3C, after passed through larger-aperture electron lens 51, diverge away from center beam **3*b*. In this case, a very large deflection angle, i.e., an angle as large as an angle of $+\phi°$, is required and thus a larger deflection error will be involved. In the 19- and 20-inch type color cathode tube, the distance from the final electron lens to the screen is 300 to 350 mm, the distance from the cathode to larger-aperture lens 51 or 21 is 20 to 30 mm, and the cathode-to-cathode distance is about 5 to 7 mm. In this case, the deflection angle $\phi$ is a very large angle, that is, an angle as large as an angle of 10° to 15°. According to the present embodiment, electron beams 3A and 3C** converges through an angle of $+\alpha°$ under the action of the electron lens. Since this angle is very small, about 1° to 4°, the deflection angle $\alpha$ one-third to one-tenth of the deflection angle $\phi$ so that the deflection angle $\alpha$ is very small compared with the deflection angle $\phi$, resulting in a smaller deflection error. Furthermore, the side electron beams diverge through a deflection angle of $-\beta°$ (1° to 3°), and thus the deflection error is cancelled.

Although use has been made of the electrostatic deflection plate in this embodiment, a magnetic field may be employed instead.

Although, in the aforementioned embodiment, a bipotential type lens is basically formed by the third and fourth grids, this invention is not restricted hereto. For example, use may also be made of uni- and tri-potential type lenses, or a composite type lens, or a combination of individual lenses and large-aperture electron lens. If the lens of a longer focal point as disclosed in U.S. Pat. No. 3,932,786 is applied to a location of the larger-aperture lens, the resultant lens performance can be much improved. Needless to say, as the larger-aperture lens use may be made of not only the electrostatic lens but also the magnetic field lens. Although, in the aforementioned embodiment, the color cathode ray has been explained in connection with the in-line type electron gun array, this invention can be applied to the case where a plurality of electron beams are used or to the usage other than that of the color cathode ray tube.

According to this invention, a color cathode ray tube equipped with an electron gun assembly for focusing a plurality of electron beams is provided in which a larger-aperture electron lens for converging the electron beams allows the electron beams to pass therethrough without being crossed therein with respect to each other and another electron lens is provided for correcting the convergence of the electron beams produced by the electron lens. According to this electron gun assembly, the larger-aperture electron lens fully exhibits its own inherent performance, and the electron beams can be readily converged in one convergent point near to the screen, while allowing the beam spot diameter on the screen to be decreased.

A high-performance color cathode ray tube, provided with an electron gun assembly of this invention, can readily be manufactured in a simpler arrangement and has a wides practical application.

Furthermore, a color cathode ray tube equipped with an electron gun assembly of this invention is provided which can attain a high-performance withtout increasing the beam-to-beam distance and can attain a better convergence with a smaller deflection power level.

What is claimed is:

1. An electron gun assembly for a cathode ray tube having a screen having first, second and third regions, comprising:

means for generating first and second side electron beams and a center beam therebetween, said first, second and center electron beams being arranged in a parallel line;

a single main electron lens for focusing the first, second and center electron beams said beams being incident in a parallel manner, onto a screen, and for converging the first and second side electron beams and the center electron beams such that the first and second side electron beams are over-converged toward the center beam at an over converged point between the main electron lens and the screen and the center electron beam passes through a predetermined convergent point between the over-converged point and the screen, said first and second side electron beams and said center beam landing on said first, second and third regions of said screen respectively and;

means for generating an electric field through which the over-converged first and second side electron beams pass, and for applying an electric force onto the overconverged side electron beams, so that the overconvergence of the side electron beams is corrected to cause the side beams and the center beam to be converged at the predetermined converged point and to be crossed at the predetermined converged point.

2. The electron gun assembly according to claim 1, wherein said first, second and center electron beams pass through different predetermined regions of said single main electron lens.

3. The electron gun assembly according to claim 1, further comprising a preliminary electron lens means, located between said generating means and said single main electron lens, for preliminarily focusing said first, second and center electron beams.

4. The electron gun assembly according to claim 1, wherein said single main electron lens has an axis, said center electron beam travels along said axis and said generating means deflects said side electron beams away from said axis.

5. The electron gun assembly according to claim 1, wherein said electric field generating means diverges said side electrons beams.

* * * * *